US009209553B2

(12) United States Patent
Rimke

(10) Patent No.: US 9,209,553 B2
(45) Date of Patent: Dec. 8, 2015

(54) PLUG-CONNECTOR HOUSING AND PLUG CONNECTOR

(71) Applicant: Kostal Kontakt Systeme GmbH, Luedenscheid (DE)

(72) Inventor: Kersten Rimke, Herscheid (DE)

(73) Assignee: Kostal Kontakt Systeme GmbH, Luedenscheid (DE)

( * ) Notice: Subject to any disclaimer, the term of this patent is extended or adjusted under 35 U.S.C. 154(b) by 0 days.

(21) Appl. No.: 14/472,879

(22) Filed: Aug. 29, 2014

(65) Prior Publication Data

US 2014/0370744 A1 Dec. 18, 2014

Related U.S. Application Data

(63) Continuation of application No. PCT/EP2013/059586, filed on May 8, 2013.

(30) Foreign Application Priority Data

May 18, 2012 (DE) ..... 10 2012 009 877

(51) Int. Cl.
*H01R 13/58* (2006.01)
*H01R 13/52* (2006.01)
*H01R 13/506* (2006.01)

(52) U.S. Cl.
CPC ..... *H01R 13/52* (2013.01); *H01R 13/506* (2013.01); *H01R 13/5205* (2013.01)

(58) Field of Classification Search
CPC ..... H01R 13/6392; H01R 13/5213; H01R 13/506; H01R 13/44; H01R 13/447; H01R 13/639; H01R 13/6395; H01R 13/6397; H01R 13/62; H01R 13/52
USPC ..... 439/460, 367, 369, 468, 470, 686, 695, 439/701, 521
See application file for complete search history.

(56) References Cited

U.S. PATENT DOCUMENTS 3,112,148 A * 11/1963 Wochner ..... H01R 4/44 174/138 F
3,683,314 A * 8/1972 Elkins ..... H01R 13/639 174/138 F (Continued)

FOREIGN PATENT DOCUMENTS

DE 20114120 U1 1/2003
DE 20304555 U1 10/2003

(Continued)

OTHER PUBLICATIONS

The International Bureau of WIPO, International Preliminary Report on Patentability for International Application No. PCT/EP2013/059586 issued Nov. 18, 2014.

(Continued)

*Primary Examiner* — Abdullah Riyami
*Assistant Examiner* — Vladimir Imas
(74) *Attorney, Agent, or Firm* — Brooks Kushman P.C.

(57) ABSTRACT

A plug-in connector includes a plug-in connector housing having first and second housing parts. The first housing part has electrical components and a blade-like part. The second housing part is connectable to the first housing part and has a recess through which an electrical line can pass to connect with the electrical components. The blade-like part covers a portion of the recess and constricts the recess to a relatively smaller feed-through region when the housing parts are connected together.

7 Claims, 2 Drawing Sheets

(56) References Cited

U.S. PATENT DOCUMENTS 4,229,616 A * 10/1980 Hotchkiss ..... H01R 13/516 174/138 F
4,382,649 A * 5/1983 Meyer ..... H01R 13/518 174/60
4,444,447 A * 4/1984 Markwardt ..... H01R 4/2454 439/392
4,449,015 A * 5/1984 Hotchkiss ..... H02G 3/10 174/138 F
4,749,363 A * 6/1988 Luska ..... H01R 13/44 439/367
5,129,839 A * 7/1992 VanSkiver ..... H01R 13/6392 439/367
5,264,663 A * 11/1993 Noguchi ..... H01R 12/592 174/84 R
5,371,323 A * 12/1994 Schneider ..... H01R 4/646 174/138 F
5,380,220 A * 1/1995 Okabe ..... H01R 13/506 439/456
5,382,178 A * 1/1995 Laloum ..... H01R 9/24 439/407
5,571,032 A 11/1996 Sano et al.
5,804,770 A * 9/1998 Tanaka ..... H01M 2/206 174/138 F
5,816,853 A * 10/1998 Buekers ..... G02B 6/4446 439/367
6,099,340 A * 8/2000 Florentine ..... H01R 13/6392 439/367
6,111,201 A * 8/2000 Drane ..... H01R 4/70 174/92
6,162,087 A * 12/2000 Hiura ..... H01R 13/5213 174/152 G
6,213,808 B1 * 4/2001 Whatmore ..... H01R 13/516 439/417
6,234,823 B1 * 5/2001 Fuess ..... H01R 13/5816 439/346
6,315,600 B1 * 11/2001 Droesbeke ..... H01R 13/5825 439/368
6,547,600 B2 * 4/2003 Yen ..... H01R 13/68 439/460
6,551,135 B2 * 4/2003 Stekelenburg ..... H01R 13/5213 439/367
6,752,646 B2 * 6/2004 McCoy ..... H01R 13/5213 439/367
6,767,243 B2 * 7/2004 McCoy ..... H01R 13/5213 439/521
6,917,255 B2 * 7/2005 Mathias ..... H01R 13/6633 333/25
6,955,558 B1 * 10/2005 Low ..... H02G 15/013 439/467
7,044,776 B2 * 5/2006 King, Jr. ..... H01R 4/36 439/521
7,189,100 B1 * 3/2007 Colbourne ..... H01R 13/6392 439/367
D616,058 S * 5/2010 Kruger ..... D22/112
8,016,607 B2 * 9/2011 Brown, II ..... B60L 11/1818 439/34
8,025,510 B2 * 9/2011 Bolshakov ..... H01R 13/443 439/136
8,436,247 B2 * 5/2013 Mase ..... H01R 4/34 174/135
8,702,440 B2 * 4/2014 Nooner ..... H01R 13/5213 439/279
8,870,587 B2 * 10/2014 Nooner ..... H01R 13/516 439/165
2005/0277335 A1 12/2005 Gordon et al.

FOREIGN PATENT DOCUMENTS

DE 102011014215 A1 9/2012
WO 04001962 A1 12/2003

OTHER PUBLICATIONS

European Patent Office, International Search Report for the corresponding International Application No. PCT/EP2013/059586 mailed Aug. 22, 2013.

* cited by examiner

PLUG-CONNECTOR HOUSING AND PLUG CONNECTOR

CROSS-REFERENCE TO RELATED APPLICATIONS

This application is a continuation of International Application No. PCT/EP2013/059586, published in German, with an International filing date of May 8, 2013, which claims priority to DE 10 2012 009 877.4, filed May 18, 2012, the disclosures of which are hereby incorporated in their entirety by reference herein.

TECHNICAL FIELD

The present invention relates to a plug-in connector housing having first and second housing parts in which the second housing part is connectable to the first housing part and has a recess through which an electrical connecting line can pass to electrically connect with electrical components of the first housing part. The present invention further relates to a plug-in connector having such a plug-in connector housing.

BACKGROUND

Housings of electrical plug-in connectors are commonly made in two parts, e.g., a first housing part and a second housing part. The first housing part is provided as the support for electrical components including plug contact elements such as plug-in connector contacts and plug pins. The second housing part is formed as a housing cap which can be connected to the first housing part. The second housing part closes the first housing part when connected to the first housing part. The plug-in connector housing is assembled when the second housing part is connected to the first housing part. The electrical components arranged inside the assembled housing are thereby protected from environmental influences.

The second housing part commonly has a recess through which an electrical connecting line can be passed to electrically connect with electrical components in the first housing part. A plug-in connector housing having such first and second housing parts with a connecting line is designated herein as a plug-in connector.

The interior of the plug-in connector housing should be protected from environmental influences as much as possible. A liquid-tight encapsulation is not always required; but an often less stringent requirement is that the electrical components be protected from conducting solid particles, in particular from metallic chips that could cause short circuits.

This requires that the cross-sectional area of the connecting line fill the recess of the second housing part as completely as possible or that an additional sealant such as a rubber gasket is arranged around or in the recess. Both of these measures increase cost and assembly effort of the plug-in connector.

It is common to preassemble electrical components in the first housing part to the insulated conductors of the connecting line. In order to complete the assembly of the plug-in connector, the housing cap (i.e., the second housing part) is pushed over the connecting line. The connecting line is thereby led through the recess of the second housing part. This assembly step is made difficult when the recess tightly encloses the connecting line. It is also difficult to push the second housing part over the connecting line when a rubber gasket is arranged around or in the recess.

It becomes more problematic when the connecting line has a sheathing surrounding insulated conductors of the connecting line. In this case, the sheathing at the end of the connecting line is removed in order to individually connect the insulated conductors to the electrical components of the first housing part. This presents the problem that during the assembly of the plug-in connector a bundle of individual insulated conductors is passed through the recess of the second housing part. The recess however has a smaller cross-section than the sheathed region of the connecting line. Since the width of the recess is determined by the sheathed region of the connecting line, a relatively large unfilled region remains in the recess. This results in the mounted plug-in connector not being sufficiently sealed against penetration of electrically conducting solid particles.

SUMMARY

An object of the present invention is a plug-in connector housing that prevents the aforementioned disadvantages in a simple and economical manner.

In carrying out at least one of the above and other objects, the present invention provides a connector having first and second housing parts. The first housing part has electrical components and a blade-like part. The second housing part is connectable to the first housing part and has a recess through which an electrical line can pass to connect with the electrical components. The blade-like part covers a portion of the recess and constricts the recess to a relatively smaller feed-through region when the housing parts are connected together.

Embodiments of the present invention are directed to a plug-in connector housing having first and second housing parts. The first housing part has electrical components. The second housing part forms a housing cap. The second housing part is connectable to the first housing part. The second housing part has a recess (i.e., an opening). An electrical connecting line for the electrical attachment of the electrical components of the first housing part is passable through the recess. The first housing part has a blade-shaped structure which largely covers the recess of the second housing part after the second housing part has been connected to the first housing part.

Embodiments of the present invention are also directed to a plug-in connector having such a plug-in connector housing.

In embodiments of the present invention, the first housing part has a blade-like part that largely covers the recess of the second housing part while the second housing part is connected to the first housing part.

In accordance with embodiments of the present invention, the width of the recess on the second housing part can be made significantly larger than the cross-section of the connecting line. Consequently, the connecting line can pass through the recess without requiring a large force to overcome friction. In order to achieve a good seal in this case, the first housing part includes a blade-like part molded thereon. The blade-like part largely covers the recess after connection of the first and second housing parts. This results in only a part of the recess remaining smaller than the feed-through region of the connecting line. The feed-through region of the connecting line can likewise be pressed together in this region by the blade-like part. In this way, a relatively good seal is achievable even when the connecting line is led through the recess as a bundle of individual connecting lines from the plug-in connector housing.

Plug-in connectors with such plug-in connector housings can advantageously be used in oil-filled transmission housings of motor vehicles. The penetration of oil into the plug-in connector housing is not a problem in this case as long as it does not entrain electrically conducting pieces such as chips produced by abrasion. A chip-tight seal of the plug-in connector housing is thereby achieved by the design in accordance with embodiments of the present invention.

The above features, and other features and advantages of the present invention are readily apparent from the following detailed description thereof when taken in connection with the accompanying drawings.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
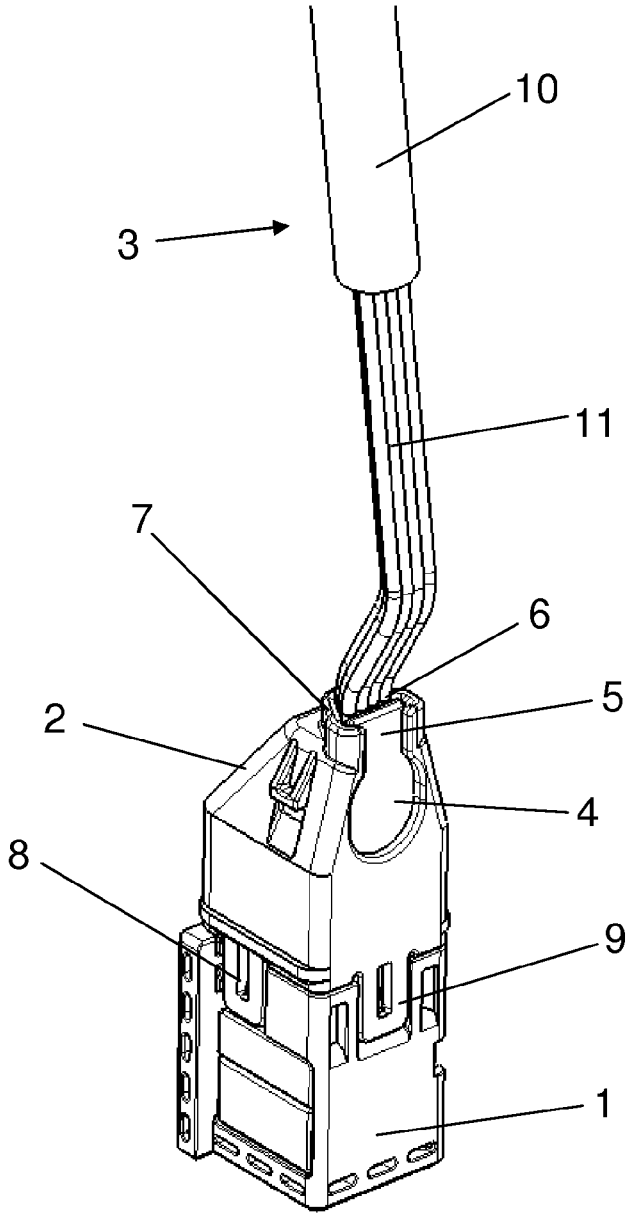
FIG. 1 illustrates a perspective view of an assembled plug-in connector in accordance with an embodiment of the present invention.

Referring now to FIG. 1, a perspective of a plug-in connector in accordance with an embodiment of the present invention is illustrated. The plug-in connector is assembled in FIG. 1.

The plug-in connector includes a plug-in connector housing made in two parts. In particular, the plug-in connector housing includes a first housing part 1 and a second housing part 2. In the assembled state of the plug-in connector as shown in FIG. 1, first and second housing parts 1, 2 are connected to one another through one or more latching elements. Each latching element is implemented, for example, as detent 8 on first housing part 1 and latching tab 9 on second housing part 2. Housing parts 1, 2 can be connected to one another in other ways such as by gluing or welding. However, latching elements 8, 9 provide a relatively simple connection technique.

First housing part 1 houses therein a plurality of electrical components including plug contact elements such as plug-in connector contacts and plug pins (not shown).

Second housing part 2 forms a housing cap for first housing part 1. Second housing part 2 is connectable to first housing part 1 through latching elements 8, 9. Second housing part includes a recess 4 (i.e., an opening).

An electrical connecting line for the electrical attachment of the electrical components of first housing part 1 is passed through recess 4 of second housing part 2. Connecting line 3 is passed through recess 4 of second housing and is attached to the electrical components in first housing part 1. In particular, connecting line 3 includes one or more insulated conductors 11 surrounded by a sheathing 10. Sheathing 10 of connecting line 3 is removed at the end of connecting line 3 that passes through recess 4 of second housing part 2 as shown in the FIGS. Sheathing 10 is removed to expose conductors 11 in order for the conductors to individually connect with the electrical components of first housing part 1.

Figure 2:
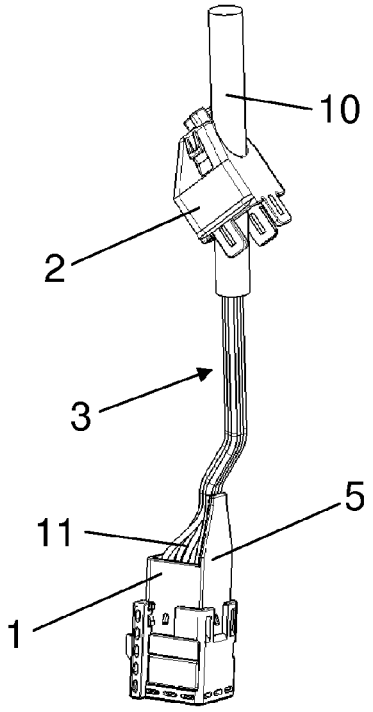
FIGS. 2, 3, and 4 illustrate respective intermediate assembly views of the plug-in connector.

First housing part has a blade-shaped part 5 (shown best in FIG. 2). Blade-like part 5 is molded onto or formed integrally with first housing part 1. In the assembled state of the plug-in connector with first and second housing parts 1, 2 connected together as shown in FIG. 1, blade-like part 5 largely covers recess 4 of second housing part 2. Blade-like part 5 thus reduces recess 4 to a constricted feed-through region 6.

Second housing part 2 includes a ring-shaped or annular collar 7. Collar 7 is molded onto or formed integrally with second housing part 2. Collar 7 is not completely closed. Collar 7 extends along a portion of the periphery of feed-through region 6. When the plug-in connector is in the assembled state as shown in FIG. 1, the free-end section of blade-like part 5 of first housing part 1 extends up to collar 7. The free-end section of blade-like part 5 closes collar 7 such that the free-end section of blade-like part 5 and collar 7 together form a completed ring. This complete ring surrounds the periphery of feed-through region 6. Connecting line 3 formed from a bundle of individual insulated conductors 11 in feed-through region 6 is thereby clamped between blade-like part 5 and collar 7.

Figure 3:
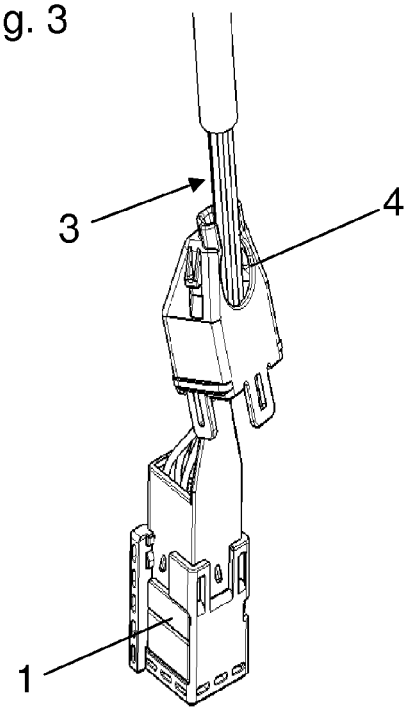
Figure 4:
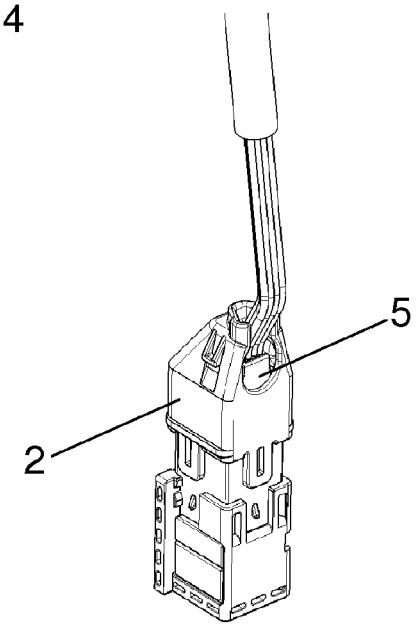

Referring now to FIGS. 2, 3, and 4, respective intermediate assembly views of the plug-in connector are shown. FIG. 2 shows first housing part 1 of the multi-pole plug-in connector, which supports a number of plug contact elements corresponding to the number of poles, such as socket contacts (not shown). Conductors 11 of connecting line 3 are respectively connected electrically and mechanically to the electrical components in first housing part 1 whereby first housing part 1 is also rigidly mechanically coupled to connecting line 3.

In order to connect second housing part 2 as the housing cap for the upper side of first housing part 1, connecting line 3 is fed through recess 4 of second housing part 2. Since exposed conductors 11 of connecting line 3 are already connected to first housing part 1, the only possibility is that second housing part 2 is pushed from the free side of connecting line 3 by its sheathing 10 in the direction toward first housing part 1. In order to enable this without exerting a relatively large force, the diameter of recess 4 is made larger than the cross-sectional diameter of sheathing 10 of connecting line 3 so that second housing part 2 can be pushed with relatively little friction over connecting line 3.

When second housing part 2 reaches first housing part 1 as shown in FIGS. 3 and 4, exposed conductors 11 of connecting line 3 clamp down on recess 4 of second housing part 2. Conductors 11 together have a significantly smaller-cross sectional area than sheathing 10 of connecting line 3. Therefore, conductors 11 are not able to entirely fill recess 4 and a relatively large region of recess 4 remains as an unfilled space. Relatively large foreign particles could penetrate through the unfilled space of recess 4 and into the plug-in connector housing.

However, this unfilled space is increasingly filled by blade-like part 5 of first housing part 1 during the course of bringing first and second housing parts 1, 2 closer together. When housing parts 1, 2 have attained their final position relative to one another, latching elements 8, 9 then latch housing parts 1, 2 to one another. Housing parts 1, 2 together then form the assembled plug-in connector housing (shown in FIG. 1). Blade-like part 5 almost completely covers only recess 4 and forces conductors 11 into the relatively small feed-through region 6, which is surrounded by collar 7. As is shown in FIG. 1, blade-like part 5 presses conductors 11 against the edge of collar 7. This causes feed-through region 6 for conductors 11 to substantially prevent penetration of macroscopic solid particles, but is not strictly impermeable to fluids.

REFERENCE SYMBOLS

1 first housing part
2 second housing part (housing cap)
3 connecting line

4 recess of second housing part
5 (blade-like) molded part of first housing part
6 feed-through region
7 (annular) collar
8 detent (latching element)
9 latching tab (latching element)
10 sheathing
11 insulated conductor(s)

While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. A connector comprising:

a first housing part having electrical components and a blade-like part; and a second housing part connectable to the first housing part and having an enclosed periphery of sides with a hollow interior therein, a first opening leading into the interior at a first end, a second opening leading into the interior at a second end, and a recess extending from the second opening along a partial portion of at least one of the sides and leading into the interior, wherein an electrical line can pass through the recess and pass through the first opening to connect with the electrical components;

wherein the blade-like part covers at least a portion of the recess and constricts the recess to a relatively smaller feed-through region when the housing parts are connected together.

2. The connector of claim 1 wherein:

the electrical line is pressed by the blade-like part at the feed-through region when the housing parts are connected together.

3. The connector of claim 1 wherein:

the electrical line is pressed between the blade-like part and a portion of the second housing part at the feed-through region when the housing parts are connected together.

4. The connector of claim 1 wherein:

the electrical line can pass through the recess when the housing parts are disconnected from one another as the recess is not constricted to the relatively smaller feed-through region when the housing parts are disconnected from one another and the electrical line cannot pass through the feed-through region when the housing parts are connected to one another as the recess is constricted to the relatively smaller feed-through region when the housing parts are connected to one another.

5. The connector of claim 1 wherein:

the first housing part includes a latching element;

the second housing part includes a corresponding latching element; and the second housing part is connectable to the first housing part through the latching elements.

6. The connector of claim 1 wherein:

the sides of the second housing part at the second end form an incompletely closed annular collar which borders a portion of the second opening;

the blade-like part closes the collar when the housing parts are connected together to thereby constrict the second opening and the recess to the relatively smaller feed-through region.

7. The connector of claim 1 wherein:

the first and second housing parts are housing parts of an oil filled transmission housing of a vehicle.

* * * * *